US007600518B2

(12) United States Patent
Oglesby et al.

(10) Patent No.: US 7,600,518 B2
(45) Date of Patent: Oct. 13, 2009

(54) SMOKING ARTICLES AND WRAPPING MATERIALS THEREFOR

(75) Inventors: Robert Leslie Oglesby, Kernersville, NC (US); Alan Benson Norman, Clemmons, NC (US); John Fitzgerald, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 561 days.

(21) Appl. No.: 11/109,404

(22) Filed: Apr. 19, 2005

(65) Prior Publication Data

US 2006/0231114 A1 Oct. 19, 2006

(51) Int. Cl.
*A24D 1/02* (2006.01)
*A24C 1/42* (2006.01)

(52) U.S. Cl. ..... 131/365; 131/284

(58) Field of Classification Search ..... 131/286, 131/288, 290, 360

See application file for complete search history.

(56) References Cited

U.S. PATENT DOCUMENTS

| | | | | |
|---|---|---|---|---|
| 1,909,924 | A | | 5/1933 | Schweitzer |
| 1,996,002 | A | | 3/1935 | Seaman |
| 1,999,223 | A | | 4/1935 | Weinberger |
| 1,999,224 | A | | 4/1935 | Miles |
| 2,013,508 | A | | 9/1935 | Seaman |
| 3,030,963 | A | | 4/1962 | Cohn |
| 4,146,040 | A | | 3/1979 | Cohn |
| 4,452,259 | A | | 6/1984 | Norman et al. |
| 4,480,650 | A | | 11/1984 | Weinert |
| 4,489,738 | A | | 12/1984 | Simon |
| 4,607,647 | A | | 8/1986 | Dashley et al. |
| 4,615,345 | A | | 10/1986 | Durocher |
| 4,739,775 | A | | 4/1988 | Hampl, Jr. |
| 5,007,440 | A | * | 4/1991 | Robinson et al. ..... 131/369 |
| 5,060,675 | A | | 10/1991 | Milford et al. |
| 5,191,906 | A | | 3/1993 | Myracle, Jr. |
| 5,263,999 | A | | 11/1993 | Baldwin et al. |
| 5,417,228 | A | | 5/1995 | Baldwin et al. |
| 5,450,863 | A | | 9/1995 | Collins et al. |
| 5,474,095 | A | | 12/1995 | Allen et al. |
| 5,540,242 | A | * | 7/1996 | Chao et al. ..... 131/365 |
| 5,820,998 | A | | 10/1998 | Hotaling et al. |
| 5,878,753 | A | | 3/1999 | Peterson et al. |
| 5,878,754 | A | | 3/1999 | Peterson et al. |

(Continued)

FOREIGN PATENT DOCUMENTS

EP 1 234 514 A2 8/2002

(Continued)

OTHER PUBLICATIONS

Norman, Alan et al., Measurement of Gas Diffusion Capacity of Cigarette Papers, 17-19, Table XI.*

(Continued)

*Primary Examiner*—Carlos Lopez
*Assistant Examiner*—Jodi Cohen
(74) *Attorney, Agent, or Firm*—Brinks Hofer Gilson & Lione

(57) ABSTRACT

A smoking article including a smokable rod manufactured using a paper wrapping material having an additive material applied thereto as a pattern. The additive material is applied as aqueous coating formulation incorporating both an alginate and hydroxypropylcellulose.

33 Claims, 1 Drawing Sheet

U.S. PATENT DOCUMENTS

| | | | | |
|---|---|---|---|---|
| 5,947,127 | A * | 9/1999 | Tsugaya et al. | 131/332 |
| 6,198,537 | B1 | 3/2001 | Bokelman et al. | |
| 6,289,897 | B1 * | 9/2001 | McAdam et al. | 131/359 |
| 6,502,613 | B2 | 1/2003 | Suzuki | |
| 6,606,999 | B2 | 8/2003 | Crooks et al. | |
| 6,725,867 | B2 | 4/2004 | Peterson et al. | |
| 6,779,530 | B2 | 8/2004 | Kraker | |
| 6,827,087 | B2 | 12/2004 | Wanna et al. | |
| 6,837,248 | B2 | 1/2005 | Zawadzki et al. | |
| 6,848,449 | B2 | 2/2005 | Kitao et al. | |
| 6,868,855 | B2 | 3/2005 | Shafer et al. | |
| 2003/0098033 | A1 * | 5/2003 | MacAdam et al. | 131/344 |
| 2003/0131860 | A1 * | 7/2003 | Ashcraft et al. | 131/365 |
| 2003/0136420 | A1 * | 7/2003 | Kraker | 131/360 |
| 2003/0150466 | A1 | 8/2003 | Kitao et al. | |
| 2003/0178039 | A1 * | 9/2003 | White et al. | 131/365 |
| 2004/0025894 | A1 * | 2/2004 | Beven et al. | 131/360 |
| 2004/0074507 | A1 * | 4/2004 | MacAdam et al. | 131/337 |
| 2004/0129281 | A1 | 7/2004 | Hancock et al. | |
| 2004/0134631 | A1 | 7/2004 | Crooks et al. | |
| 2004/0231685 | A1 | 11/2004 | Patel et al. | |
| 2004/0255965 | A1 | 12/2004 | Perfetti et al. | |
| 2004/0261805 | A1 | 12/2004 | Wanna et al. | |
| 2004/0261807 | A1 | 12/2004 | Dube et al. | |
| 2005/0039764 | A1 | 2/2005 | Barnes et al. | |
| 2005/0045297 | A1 | 3/2005 | Garg et al. | |
| 2005/0066986 | A1 | 3/2005 | Nestor et al. | |
| 2005/0087202 | A1 * | 4/2005 | Norman et al. | 131/280 |
| 2005/0172977 | A1 * | 8/2005 | Jadot et al. | 131/365 |
| 2006/0090769 | A1 * | 5/2006 | Woodson et al. | 131/364 |
| 2006/0174904 | A1 * | 8/2006 | Wanna | 131/365 |
| 2006/0231114 | A1 * | 10/2006 | Oglesby et al. | 131/365 |
| 2007/0084475 | A1 * | 4/2007 | Oglesby | 131/365 |
| 2008/0078417 | A1 * | 4/2008 | Wanna et al. | 131/372 |
| 2008/0115794 | A1 * | 5/2008 | Oglesby | 131/58 |

FOREIGN PATENT DOCUMENTS

| | | | |
|---|---|---|---|
| WO | WO 02/44700 | A1 | 6/2002 |
| WO | WO 02/055294 | A1 | 7/2002 |
| WO | WO 2004/047572 | A1 | 6/2004 |
| WO | WO 2004/057986 | A2 | 7/2004 |
| WO | WO 2004/095957 | A2 | 11/2004 |

OTHER PUBLICATIONS

Baker et al., The Diffusion of Carbon Monoxide out of Cigarettes, *Beitr. Tabakforsch.*, vol. 9(3), 131-140 (1977).

Drake et al., On a Cell to Measure Diffusion Coefficients of Gases through Cigarette Papers, *Int. J. Heat Mass Transfer*, vol. 23, 127-134 (1980).

Baker, The Viscous and Inertial Flow of Air through Perforated Papers, *Beitr. Tabakforsch.*, vol. 14(5), 253-260 (1989).

Miura, Oxygen Diffusion through Cigarette Paper, *Beitr. Tabakforsch.*, vol. 19(4), 205-208 (2001).

Miura et al., Heat Emission from a Burning Cigarette, *Beitr. Tabakforsch.*, Vol. 19(5), 245-249 (2001).

Rostami et al., Modeling the Diffusion of Carbon Monoxide and Other Gases from the Paper Wrapper of a Cigarette During Puffing, *J. Anal. Pyrolysis*, vol. 66, 263-280 (2003).

Rostami et al., Modeling of a Smoldering Cigarette, *J. Anal. Pyrolysis*, vol. 66, 281-301 (2003).

Norman et al., Measurement of Gas Diffusion Capacity of Cigarette Papers (manuscript submitted for publication (2005)).

* cited by examiner

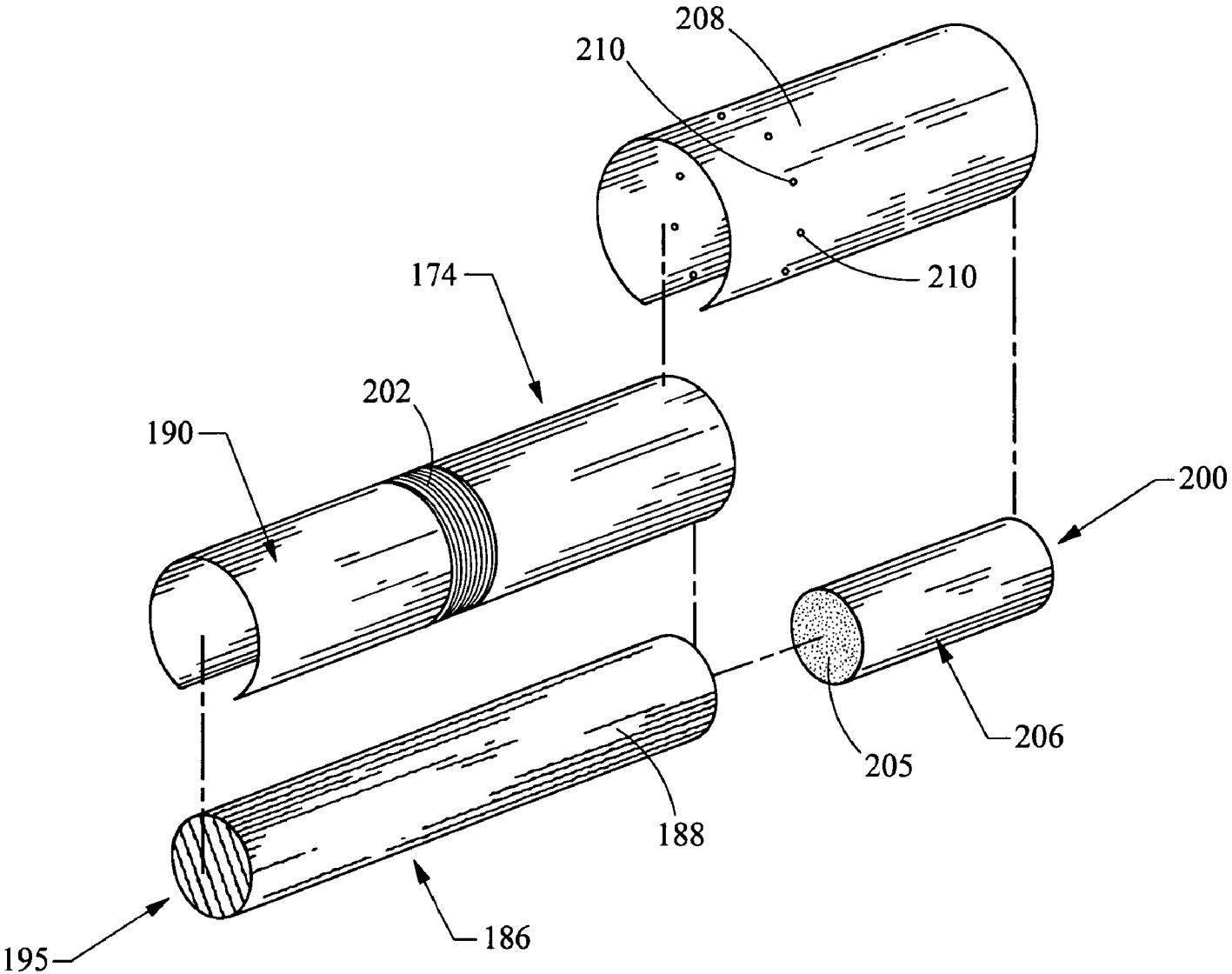
200
206
205
210
208
210
188
174
202
186
190
195

SMOKING ARTICLES AND WRAPPING MATERIALS THEREFOR

FIELD OF THE INVENTION

The present invention relates to smoking articles, and in particular, to wrapping materials associated with those smoking articles. More specifically, the present invention relates to cigarette rods, and in particular, to the application of additive material to desired locations of wrapping materials of cigarettes.

BACKGROUND OF THE INVENTION

Smoking articles, such as cigarettes, have a substantially cylindrical rod-shaped structure and include a charge, roll, or column of smokable material, such as shredded tobacco, surrounded by a paper wrapper, to form a "cigarette rod," "smokable rod" or a "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate filter elements comprising, for example, activated charcoal particles. Typically, the filter element is attached to one end of the tobacco rod using a circumscribing wrapping material known as "tipping paper."

A cigarette is used by a smoker by lighting one end of that cigarette, and burning the tobacco rod. The smoker then receives mainstream smoke into his or her mouth by drawing on the opposite end of the cigarette. During the time that the cigarette is not being drawn upon by the smoker, the cigarette remains burning.

Numerous attempts have been made to control the manner that a cigarette burns when the cigarette is not being drawn upon. For example, cigarette papers have been treated with various materials to cause cigarettes incorporating those papers to self extinguish during periods when those cigarettes are lit but are not being actively puffed. Certain treatment methods have involved applying materials to the paper in circumferential bands or longitudinal stripes, creating areas that affect the burn rate of cigarettes incorporating that type of cigarette paper. See, for example, U.S. Pat. No. 3,030,963 to Cohn; U.S. Pat. No. 4,146,040 to Cohn; U.S. Pat. No. 4,489,738 to Simon; U.S. Pat. No. 4,480,650 to Weinert; U.S. Pat. No. 4,615,345 to Durocher; U.S. Pat. No. 6,606,999 to Crooks et al; U.S. Pat. No. 6,827,087 to Wanna et al; and U.S. Pat. No. 6,848,449 to Kitao et al.; and U.S. Patent Application Pub. Nos. 2003/0131860 to Ashcraft et al.; 2003/0150466 to Kitao et al.; 2004/0129281 to Hancock et al.; and 2004/0231685 to Patel et al. In addition, numerous references disclose applying films to the paper wrapping materials of tobacco rods. See, for example, U.S. Pat. No. 1,909,924 to Schweitzer; U.S. Pat. No. 4,607,647 to Dashley; and U.S. Pat. No. 5,060,675 to Milford et al.

"Banded" paper wrapping materials that are used for cigarette manufacture possess segments defined by the composition, location, and properties of the various materials within those wrapping materials. Numerous references contain disclosures suggesting various banded wrapping material configurations. See, for example, U.S. Pat. No. 1,996,002 to Seaman; U.S. Pat. No. 2,013,508 to Seaman; U.S. Pat. No. 4,452,259 to Norman et al.; U.S. Pat. No. 5,417,228 to Baldwin et al.; U.S. Pat. No. 5,878,753 to Peterson et al.; U.S. Pat. No. 5,878,754 to Peterson et al.; U.S. Pat. No. 6,198,537 to Bokelman et al.; U.S. Pat. No. 6,779,530 to Kraker; U.S. Pat. No. 6,837,248 to Zawadzki et al; and U.S. Pat. No. 6,725,867 to Peterson et al.; and PCT Application Pub. No. WO 04/047572 to Ashcraft et al. Methods for manufacturing banded-type wrapping materials also have been disclosed. See, for example, U.S. Pat. No. 4,739,775 to Hampl, Jr. et al.; and U.S. Pat. No. 5,474,095 to Allen et al.; and PCT Application Pub. Nos. WO 02/44700 to Watkins and WO 02/055294 to Hammersmith et al. Some of those references describe banded papers having segments of paper, fibrous cellulosic material, or particulate material adhered to a paper web. See, U.S. Pat. No. 5,263,999 to Baldwin et al.; U.S. Pat. No. 5,417,228 to Baldwin et al.; U.S. Pat. No. 5,450,863 to Collins et al.; and U.S. Pat. No. 6,502,613 to Suzuki; and U.S. Patent Application Pub. No. 2005/0045297 to Garg et al. A representative method for manufacturing cigarettes having treated wrapping materials is set forth in U.S. Pat. No. 5,191,906 to Myracle, Jr. et al. Additive materials can be applied to cigarette paper wrapping materials while those wrapping materials are being used for cigarette manufacture (i.e., in a so-called "on-line" fashion). See, for example, U.S. Pat. No. 1,999,223 to Weinberger; U.S. Pat. No. 1,999,224 to Miles; and U.S. Pat. No. 6,848,449 to Kitao et al.; and U.S. Patent Application Pub. Nos. 2003/0150466 to Kitao et al.; 2004/0129281 to Hancock et al; 2004/0261805 to Wanna et al; and 2005/0039764 to Barnes et al.; and PCT Application Pub. No. WO 04/057986 to Hancock et al.

It would be desirable to apply additive material in a controlled manner as a predetermined pattern (e.g., as bands) to wrapping material of the type that is used for the manufacture of smokable rods for cigarettes. It also would be desirable to provide an additive material formulation that is capable of being applied to the wrapping material in an efficient and effective manner. It also would be desirable to ensure that the wrapping material so treated with additive material, when employed for the manufacture of a cigarette rod, yields a cigarette that meets standards of quality and behavior desired by the manufacturer of that cigarette.

SUMMARY OF THE INVENTION

The present invention provides manners and methods for manufacturing smoking articles, such as cigarettes. In a preferred aspect of the present invention, a suitable additive material is applied to a cigarette rod wrapping material. Preferred additive materials incorporate components that include both alginate and hydroxypropylcellulose materials. The additive material is applied to at least one major surface of the wrapping material, and most preferably, to one major surface of the wrapping material.

The present invention also relates to wrapping materials having additive material formulations applied thereto (most preferably in a controlled manner), and to cigarettes manufactured from those wrapping materials. For example, the additive materials are applied to wrapping materials as formulations composed of both alginate and hydroxypropylcellulose materials. Such formulations of additive materials are most preferably water-based formulations. Other ingredients, such as preservatives, pigments and/or colorants, also can be incorporated into those formulations. Though not preferred, other ingredients, such as water soluble and/or water insoluble filler materials (e.g., sodium chloride and/or calcium carbonate) can be incorporated into those formulations.

Certain aspects of the present invention involve transferring additive material to, and retaining additive material on, desired locations of a wrapping material (e.g., paper wrapping web). For example, wrapping material having an adhesive-type formulation incorporating additive material applied thereto may then be dried (e.g., to remove water from a water-based formulation) and wound onto a roll that is adapted for later use for smoking article manufacture.

Other aspects of the present invention involve transferring additive material to, and retaining additive material on, desired locations of, a wrapping material suitable for use for smoking article manufacture (e.g., paper wrapping web) when manufacturing smoking articles from those materials using a cigarette making machine. That is, a formulation of additive material is applied to a continuous advancing strip of a paper web within a region of an automated cigarette making machine system (e.g., a machine designed to produce a continuous cigarette rod) in a desired amount, in a desired configuration and in a desired location.

For a wrapping material of the present invention, the region thereof coated with coating formulation of the present invention most preferably exhibits a diffusion capacity in that coated region (when measured at ambient temperature) that is relatively low, but exhibits a diffusion capacity in that coated region (when measured after being subjected to exposure to a temperature significantly above ambient temperature) that is relatively high. That is, the amounts of alginate and hydroxypropylcellulose relative to one another, and the total amount of those components applied to the wrapping material (e.g., as a coated film) are such that the wrapping material exhibits the foregoing behavior.

In another aspect of the invention, a smoking article incorporating a tobacco rod manufactured from wrapping material treated with the additive material formulation of the present invention can possess at least one band of additive material located in a region of its tobacco rod such that the band is capable of providing that smoking article with the ability to meet certain smoking article extinction criteria. Certain smoking articles of the present invention possessing tobacco rods manufactured using certain appropriately treated wrapping materials, when tested using the methodology set forth in the Cigarette Extinction Test Method by the National Institute of Standards and Technology (NIST), Publication 851 (1993) using 10 layers of Whatman No. 2 filter paper, meet criteria requiring extinction of greater than about 50 percent, preferably greater than about 75 percent, more preferably greater than about 90 percent, and most preferably about 100 percent, of cigarettes tested. Certain cigarettes of the present invention possessing tobacco rods manufactured using certain appropriately treated wrapping materials, when tested using the methodology set forth in the methodology set forth in ASTM Designation: E 2187-2b using 10 layers of Whatman No. 2 filter paper, meet criteria requiring extinction of greater than about 50 percent, preferably greater than about 75 percent, more preferably greater than about 90 percent, and most preferably about 100 percent, of cigarettes tested.

BRIEF DESCRIPTION OF THE DRAWINGS

The FIGURE is an exploded perspective of smoking article, showing the smokable material, the wrapping material components, and the filter element.

DETAILED DESCRIPTION OF THE PREFERRED EMBODIMENTS

Referring to the FIGURE, there are shown the components of a smoking article 174 in the form of a cigarette. The cigarette 174 includes a generally cylindrical rod 186 of a charge or roll of smokable filler material 188 contained in a circumscribing wrapping material 190 of the present invention. The rod 186 is conventionally referred to as a "tobacco rod". The ends of the tobacco rod are open to expose the smokable filler material. At one end of the tobacco rod 186 is the lighting end 195, and at the other end is shown a filter element 200. The cigarette 174 is shown as having one printed band 202 printed on wrapping material 190, and that band entirely circumscribes the cigarette rod in a direction transverse to the longitudinal axis of the cigarette. That is, the band provides a cross-directional region relative to the longitudinal axis of the cigarette. The band most preferably is applied to the inner surface of the wrapping material (i.e., facing the smokable filler material), but can be, in a much less preferred embodiment, on the outer surface of the wrapping material. Although the cigarette shown in The FIGURE possesses wrapping material having one band, the cigarette also can possess wrapping material having spaced bands numbering two, three, or more. The band 202 comprises additive materials of a water-based coating formulation that incorporates both alginate and hydroxypropylcellulose film-forming materials.

The cigarette 174 normally includes a filter element 200 or other suitable mouthpiece positioned adjacent one end of the tobacco rod 186 such that the filter element and tobacco rod are axially aligned in an end-to-end relationship, preferably abutting one another. Filter element 200 has a generally cylindrical shape, and the diameter thereof is essentially equal to the diameter of the tobacco rod. The ends of the filter element are open to permit the passage of air and smoke therethrough. The filter element 200 includes filter material 205 (e.g., plasticized cellulose acetate tow) that is overwrapped along the longitudinally extending surface thereof with circumscribing plug wrap material 206. The filter element 200 can have two or more filter segments, and/or flavor additives incorporated therein.

The filter element 200 is attached to the tobacco rod 186 by tipping material 208 which circumscribes both the entire length of the filter element and an adjacent region of the tobacco rod. The inner surface of the tipping material 208 is fixedly secured to the outer surface of the plug wrap 206 and the outer surface of the wrapping material 190 of the tobacco rod, using a suitable adhesive. A ventilated or air diluted smoking article is provided with an air dilution means, such as a series of perforations 210, each of which extend through the tipping material and plug wrap.

Various representative types of cigarette components are set forth in U.S. Patent Application Pub. Nos. 2004/0255965 to Perfetti et al.; 2004/0261807 to Dube et al.; and 2005/0066986 to Nestor et al.; which are incorporated herein by reference.

Various types of equipment and methods for applying additive material formulation to smoking article wrapping material are known. For example, representative types of equipment and the operation thereof are set forth in U.S. Pat. No. 6,848,449 to Kitao et al.; U.S. Patent Application Pub. Nos. 2003/0150466 to Kitao et al.; 2004/0129281 to Hancock et al.; 2004/0231685 to Patel et al; and 2005/0039764 to Barnes et al.; and PCT Application Pub. No. WO 04/057986 to Hancock et al., which are incorporated herein by reference. Other representative application techniques are set forth in U.S. Pat. No. 6,779,530 to Kraker and PCT Application Pub. Nos. WO 04/047572 to Ashcraft et al. and WO 04/095957 to Bray et al., which are incorporated herein by reference. As such, there are various known manners and methods for applying additive material formulations in a desired manner (e.g., as a coating) to desired locations on wrapping materials, such as paper wrapping materials suitable for use for the manufacture of tobacco rods for cigarettes.

Coating formulation incorporating the additive material typically is applied to wrapping material that is supplied from a roll. In one regard, the formulation can be applied to wrapping material supplied from a bobbin. The amount of wrapping material on a bobbin can vary, but the length of continuous strip of wrapping material on a bobbin typically is more than about 6,000 meters; and generally, the length of continuous strip of wrapping material on a bobbin typically is less than about 7,000 meters. The width of the wrapping material can vary, depending upon factors such as the circumference of the smokable rod that is manufactured and the width of the overlap region zone that provides for the sideseam. Typically, the width of a representative continuous strip of wrapping material useful for cigarette rod manufacture is about 24 mm to about 30 mm.

Paper wrapping materials of the present invention are useful as components of smoking articles such as cigarettes. Preferably, one layer of the wrapping material of the present invention is used as the wrapping material circumscribing the smokable material, and thereby forming the tobacco rod of a cigarette. Most preferably, the wrapping material possesses the coated regions located on the "wire" side thereof; and the "wire" side of that wrapping material forms the inner surface of the circumscribing wrapping material of the tobacco rod. That is, when the wrapping material is used to manufacture a smokable rod, the "wire side" major surface of the wrapping material that circumscribes the smokable material faces that smokable material. Typically, the "felt" side of the wrapping material is used as the visible outer surface of the tobacco rod. The terms "wire side" and "felt side" in referring to the major surfaces of paper sheet are readily understood as terms of art to those skilled in the art of paper and cigarette manufacture.

The selection of a particular wrapping material will be readily apparent to those skilled in the art of cigarette design and manufacture. Typical paper wrapping materials are manufactured from fibrous materials (e.g., a cellulosic materials, such as wood pulp), and optional filler materials (e.g., calcium carbonate), to form so-called "base sheets." Such wrapping material base sheets have basis weights that can vary, and exhibit inherent porosities that can vary. See, for example, the representative wrapping materials, including those commercially available paper wrapping materials that are set forth in U.S. Pat. Application Pub. No. 2004/0129281 to Hancock et al.; PCT Application Pub. Nos. WO 04/047572 to Ashcraft et al.; and WO 04/057986 to Hancock et al. Other wrapping materials, and components thereof, are set forth in U.S. Pat. No. 6,868,855 to Shafer et al. and U.S. Pat. Application Pub. No. 2004/0134631 to Crooks et al.; and EP 1234514 to Grider et al.; which are incorporated herein by reference.

The base sheets can be treated so as to impart a change to the overall physical characteristics thereof and/or so as to introduce a change in the overall chemical compositions thereof. For example, a base sheet can be electrostatically perforated, coated with a film, treated with burn chemicals, or treated with flavoring agents or aroma precursors. Various additives can be added to, or otherwise incorporated into, the wrapping material simultaneously to, or at different stages during or after, the paper manufacturing process. See, for example, U.S. Pat. Application Pub. No. 2004/0129281 to Hancock et al.; PCT Application Pub. Nos. WO 04/047572 to Ashcraft et al.; and WO 04/057986 to Hancock et al.

The coating formulation includes a mixture of at least two film-forming agents. One exemplary film-forming agent is an alginate, and exemplary preferred alginates include sodium alginate, potassium alginate, ammonium alginate, and the like. Representative alginates include those types of alginates that are set forth in U.S. Pat. No. 6,779,530 to Kraker. For example, exemplary alginates are available as Kelgin RL, Manucol LD and Manucol LB from ISP Corporation. (Wayne, N.J.). Preferred alginates have a viscosity in the range of about 20 to about 100 centipoise, more preferably about 20 centipoise to about 50 centipoise, when present in a 3 percent by weight solution in water at 25° C. A second exemplary film-forming agent is a hydroxypropylcellulose, and an exemplary preferred hydroxypropylcellulose is available as Klucel EF from Hercules, Inc. (Wilmington, Del.). Preferred hydroxypropylcelluloses have a viscosity in the range of about 200 centipoise to about 600 centipoise when present in a 10 percent by weight solution in water at 25° C. Preferably, the film-forming agent comprises an alginate and a hydroxypropylcellulose. More preferably, the film-forming agent consists essentially of an alginate and a hydroxypropylcellulose.

For representative coating formulations, the amount of each of the alginate and hydroxypropylcellulose relative to one another can vary. Typically, the alginate is employed in amounts sufficient to provide a film or coating on the wrapping material, and to provide a coated region having a relatively low porosity. In addition, the alginate typically is employed such that the coating formulation has the form of a paste that can be readily applied in a desired fashion to the wrapping material, and that rheology of the coating formulation is not overly thick or overly thin. Typically, the hydroxypropylcellulose is employed in amounts sufficient to provide an enhancement in the difference between the diffusion capacity in that coated region when measured at ambient temperature and the diffusion capacity in the coated region when measured after being subjected to exposure to a temperature significantly above ambient temperature. In addition, the hydroxypropylcellulose is employed in sufficiently low amounts such that the rheology of the coating formulation is not undesirably affected, and that the coating formulation can be readily applied in a desired fashion to the wrapping material.

Generally, the weight of alginate within the coating formulation is greater than the weight of the hydroxypropylcellulose within the formulation. Typically, the amount of alginate within the coating formulation often makes up at least about 65 percent, and frequently at least about 75 percent, of the combined weight of the alginate and hydroxypropylcellulose within the formulation. Typically, the amount of hydroxypropylcellulose within the coating formulation often makes up at least about 5 percent, and frequently at least about 10 percent, of the combined weight of the alginate and hydroxypropylcellulose within the formulation. Typically, the amount of hydroxypropylcellulose is less than 35 percent, preferably less than 25 percent, and more preferably less than 20 percent of the combined weight of the alginate and hydroxypropylcellulose within the formulation.

The coating formulation can incorporate other ingredients in addition to the aforementioned film-forming materials. See, for example, the types of ingredients set forth in U.S. Pat. Application Pub. No. 2004/01292811 to Hancock et al and PCT Application Pub. No. WO 04/057986 to Hancock et al. Those ingredients can be dissolved within the liquid carrier of the coating formulation, or dispersed or suspended within that coating formulation. Those other ingredients can be employed in order to provide specific properties or characteristics to the wrapping material. For example, the coating formulation can incorporate flavoring agents, humectants, wetting agents, preservatives, colorants or pigments, and the like. Though not preferred, the coating formulation can incorporate water soluble (e.g., sodium chloride or potassium chloride) and/or water insoluble (e.g., calcium carbonate or magnesium oxide) fillers. Preferably, the optional ingredients are essentially chemically non-reactive with other components of the formulation, at least at those conditions at which the formulation is employed. Preferably, the optional ingredients are employed in amounts that do not result in introduction of undesirable rheology to the coating formulation (e.g., introducing an undesirably high viscosity to the formulation).

The suitable solvent or liquid carrier of the coating formulation most preferably is a liquid having an aqueous character, and can include relatively pure water (e.g., tap water or deionized water). Although not all components of the coating formulation are necessarily soluble in the liquid carrier, it is most preferable that the film-forming components be soluble (or at least highly dispersible) in that liquid. By "soluble" in referring to the components of the coating formulation with respect to the liquid solvent, it is meant that the components for a thermodynamically stable mixture when combined with the solvent, have a significant ability to dissolve in that solvent, and do not form precipitates to any significant degree when present in that solvent.

The alginate and hydroxypropylcellulose preferably are incorporated within an aqueous liquid to produce a coating formulation that is considered to be a thickened mixture. Preferred coating formulations can be considered to be a "paste." A representative water-based coating formulation having a combined content of alginate and hydroxypropylcellulose of about 22.5 weight percent exhibits a Brookfield viscosity (No. 6 spindle, 10 rpm, 25° C.) of about 40,000 centipoise to about 70,000 centipoise. Preferred coating formulations also can be considered to be adhesives, as it is desirable for those coatings to remain in intimate contact with (e.g., to adhere to or otherwise remain secured to) desired locations on the wrapping material to which those formulations are applied.

Typical coating formulations incorporate about 65 to about 90, generally about 70 to about 85, weight percent liquid carrier (e.g., an aqueous liquid, such as relatively pure water); about 10 to about 35, generally about 15 to about 30, weight percent of the film-forming agent mixture (e.g., the combined weight of the alginate and hydroxypropylcellulose); based on the total weight of liquid carrier and film-forming agent mixture.

The relative amounts of the various optional components of the coating formulation can vary. When employed, the amount of humectant often ranges from about 1 percent to about 5 percent, preferably about 2 to about 3 percent, based on the total weight of the formulation. When employed, the amount of wetting agent often ranges from about 0.5 percent to about 2 percent, preferably about 0.8 to about 1 percent, based on the total weight of the formulation. When employed, the amount of preservative often ranges from about 0.01 percent to about 3 percent, preferably about 0.5 percent, based on the total weight of the formulation.

Coating formulations, such as the types of water-based coating formulations desired hereinbefore, are subjected to drying conditions after those formulations have been applied to the wrapping material, such as a continuous strip of paper web of wrapping material. Preferably, sufficient solvent is removed from the formulation after that formulation has been applied to the wrapping material such that the additive material that remains in contact with the wrapping material does not exhibit a sticky or tacky character or nature. Preferably, sufficient solvent (e.g., water) is removed from the formulation after that formulation has been applied to the wrapping material such that the additive material that remains in contact with the wrapping material exhibits a solvent (e.g., moisture) content of less than about 10 percent, more preferably less than about 8 percent, based on the weight of the coating formulation that remains in contact with the wrapping material. Typically, sufficient solvent (e.g., water) is removed from the formulation after that formulation has been applied to the wrapping material such that the formulation that remains in contact with the wrapping material exhibits a solvent (e.g., moisture) content of about 4 percent to about 6 percent, based on the weight of the coating formulation that remains in contact with the wrapping material.

The amount of coating formulation that is applied to the wrapping material can vary. Typically, the coating formulation is applied to the wrapping material such that the dry weight of the additive material on the wrapping material is least about 1 g/m$^2$, often at least about 2 g/m$^2$, and frequently at least about 3 g/m$^2$. Typically, the coating formulation is applied to the wrapping material such that the dry weight of the additive material on the wrapping material is less than about 10 g/m$^2$, often is less than about 7 g/m$^2$, and frequently is less than about 4 g/m$^2$. For example, a paper wrapping material having a dry basis weight of about 25 g/m$^2$ can be coated with coating formulation and dried to have a resulting overall dry basis weight in the coated regions of about 27 g/m$^2$ to about 28.5 g/m$^2$.

Coated regions of the wrapping material useful as the circumscribing wrapper of tobacco rods for cigarettes are produced using additive materials that are effective in reducing the inherent porosity of the wrapping material in those regions. Film-forming materials coated onto the wrapping material have a tendency to reduce the porosity of the wrapping material. Typical coated regions of the wrapping materials have inherent porosities that can vary. Typically, the inherent porosities of the coated regions of the wrapping materials are less than about 9 CORESTA units, and usually are less than about 8 CORESTA units. Typically, the inherent porosities of the coated regions of the wrapping materials are at least about 0.1 CORESTA unit, usually are at least about 1 CORESTA unit, often are at least about 3 CORESTA units. Preferably, the inherent porosities of the coated regions of the wrapping materials, particularly those wrapping materials that are used for the manufacture of cigarettes designed to meet certain cigarette extinction test criteria, are from about 3 CORESTA units to about 6 CORESTA units.

The wrapping material can possess patterns of predetermined shapes and sizes positioned at predetermined locations, and hence, cigarettes appropriately manufactured from that wrapping material can possess coated patterns of predetermined shapes and sizes positioned at predetermined locations on their smokable rods. Representative patterns are set forth in U.S. Pat. Application Pub. No. 2004/0129281 and PCT Application Pub. No. WO 04/057986, both to Hancock et al. For example, shapes of coated regions, compositions of the coating formulations, or amounts or concentrations of coating materials, can change over the length of the wrapping material. The relative positioning of the printed regions can be selected as desired. For example, wrapping materials that are used for the production of cigarettes designed to meet certain cigarette extinction test criteria, the pattern most preferably has the form of spaced continuous bands that are aligned transversely or cross directionally to the longitudinal axis of the wrapping material. Cross-directional lines or bands that are essentially perpendicular to the longitudinal axis of the wrapping material often extend sufficiently across the wrapping material such that smokable rods manufactured from that wrapping material extend virtually completely around those smokable rods. Cigarettes also can be manufactured from wrapping materials possessing discontinuous bands positioned in a spaced apart relationship. For wrapping materials of those cigarettes, it is most preferred that discontinuous bands (e.g., bands that are composed of a pattern, such as a series of dots, grids or stripes) cover at least about 70 percent of the surface of the band area or region of the wrapping material.

Preferred wrapping materials possess coatings in the form of bands that extend across the wrapping material, generally perpendicular to the longitudinal axis of the wrapping material. The widths of the individual bands can vary, as well as the spacing between those bands. Typically, those bands have widths of at least about 2 mm, usually at least about 3 mm, frequently at least about 4 mm. Typically, those bands have widths of up to about 8 mm, usually up to about 7 mm. Preferred bands have widths of about 4 mm to about 7 mm, and often have widths of about 6 mm to about 7 mm. Such bands can be spaced apart such that the spacing between the bands (i.e., as measured from the inside adjacent edges of the bands) is at least about 10 mm; often at least about 15 mm, frequently at least about 20 mm, often at least about 25 mm, in certain instances at least about 30 mm, and on occasion at least about 35 mm; but such spacing usually does not exceed about 50 mm. For certain preferred wrapping materials, the bands are spaced apart such that the spacing between the bands is about 15 mm to about 25 mm, more preferably about 18 mm to about 24 mm.

Preferably, the coating formulation has an overall composition, and is applied in a manner and in an amount, such that the physical integrity of the wrapping material is not adversely affected when the coating formulation is applied to selected regions of the wrapping material. It is desirable that the components of the coating formulation applied to wrapping materials not adversely affect to any significant degree (i) the appearance of cigarettes manufactured from those wrapping materials, (ii) the nature or quality of the smoke generated by those cigarettes, (iii) the desirable burn characteristics of those cigarettes, or (iv) the desirable performance characteristics of those cigarettes. Specifically, it desirable that components of the coating formulation not introduce undesirable sensory characteristics to the smoke generated by a smoke article incorporating a wrapping material treated with that coating formulation. For preferred cigarettes, it is desirable that the coating formulation applied to the wrapping material provide the desirable extinction performance characteristics to the cigarettes manufactured using that wrapping material at relatively low coating or application levels.

Diffusion, with regards to a cigarette wrapping material having a coated region of additive material, is the amount of gas transported through the wrapping material when a gas concentration gradient is present. See, Baker et al., The Diffusion of Carbon Monoxide out of Cigarettes, *Beitr. Tabakforsch.*, Vol. 9(3), 131-140 (1977); Drake et al., On a Cell to Measure Diffusion Coefficients of Gases through Cigarette Papers, *Int. J. Heat Mass Transfer*, Vol. 23, 127-134 (1980); Baker, The Viscous and Inertial Flow of Air through Perforated Papers, *Beitr. Tabakforsch.*, Vol. 14(5), 253-260 (1989); Miura, Oxygen Diffusion through Cigarette Paper, *Beitr. Tabakforsch.*, Vol. 19(4), 205-208 (2001); Miura et al., Heat Emission from a Burning Cigarette, *Beitr. Tabakforsch.*, Vol. 19(5), 245-249 (2001); Rostami et al., Modeling the Diffusion of Carbon Monoxide and Other Gases from the Paper Wrapper of a Cigarette During Puffing, *J. Anal. Pyrolysis*, Vol. 66, 263-280 (2003); Rostami et al., Modeling of a Smoldering Cigarette, *J. Anal. Pyrolysis*, Vol. 66, 281-301 (2003). An apparatus suitable for measuring the diffusion capacity of a wrapping material, including coated regions thereof, is set forth in U.S. application Ser. No. 10/695,495, filed Oct. 27, 2003. See, also, Norman et al., Measurement of Gas Diffusion Capacity of Cigarette Papers (2005).

A preferred wrapping material possesses a coated region exhibiting a diffusion capacity in that coated region (when measured at ambient temperature) that is relatively low, but exhibits a diffusion capacity in the coated region (when measured after being subjected to exposure to a temperature significantly above ambient temperature) that is relatively high. Typical preferred ratios of diffusion capacities for a coated region of a wrapping material embodiment of the present invention (e.g., for a wrapping material heated at about 230° C. for an effective period of time and cooled to ambient for measurement, relative to a wrapping material maintained and measured at ambient temperature) can be greater than 3:1, often can be greater than 5:1, and even can be greater than 7:1. Preferably, a wrapping material coated with an appropriate amount of coating formulation of the present invention (i.e., appropriate amounts of alginate and hydroxypropylcellulose) provides such a ratio of diffusion capacities that is higher than that ratio provided by a comparable wrapping material coated with a comparable amount of a coating formulation primarily comprising alginate. For example, a wrapping material coated with about 3 $g/m^2$ of a coating formulation representative of the present invention exhibits such a ratio of diffusion capacities of 5.1:1, while that wrapping material similarly coated with a comparable amount of alginate exhibits such a ratio of diffusion capacities of about 3.7:1. See, U.S. application Ser. No. 10/695,495, filed Oct. 27, 2003. See, also, Norman et al., Measurement of Gas Diffusion Capacity of Cigarette Papers (2005).

A preferred embodiment of a wrapping material includes one or more bands of a coating formulation of the present invention. After heating substantially above ambient temperature, and preferably at about 230° C. for about 15 minutes, the portion(s) of the wrapping material with the band(s) of the coating formulation preferably has a diffusion capacity of at least about 0.5 cm/sec. More preferably, the diffusion capacity is greater than about 0.6 cm/sec. Yet more preferably, the diffusion capacity is greater than about 0.7 cm/sec, and still more preferably the diffusion capacity is greater than about 0.75 cm/sec. In preferred embodiments of the wrapping material, the coating formulation is applied to a density of about 1.5 $g/m^2$ to about 3 $g/m^2$.

A preferred cigarette incorporating a tobacco rod manufactured from wrapping material treated with the additive material formulation of the present invention meets extinction criteria while also exhibiting a propensity to avoid self-extinction during normal smoking conditions. That is, a preferred cigarette, while being capable of meeting the certain extinction criteria, does not experience free air self-extinction to a significant degree, and most preferably there is a low rate of occurrence free air self-extinction. For example, a preferred cigarette does not have a tendency to undergo premature extinction, such as when lit cigarettes are held in the smoker's hand or when placed in an ashtray for a brief period of time. Preferred cigarettes undergo free air self-extinction for less than about 30 percent, preferably for less than about 15 percent, and most preferably for 0 percent, of cigarettes tested. Free air self-extinction with regards to a cigarette having a tobacco rod incorporating a wrapping material possessing circumscribing bands of additive material relates to those burning cigarette rods that extinguish when left to burn in air (and not in contact with a substrate).

A preferred method of the present invention includes providing a wrapping paper; providing a coating formulation that comprises alginate, hydroxypropylcellulose, and a liquid carrier; applying the coating formulation to at least a portion of the wrapping material; and heating the wrapping material substantially above ambient temperature. Heating the wrapping material substantially above ambient temperature preferably includes heating it in an atmosphere of about 230° C. for about 15 minutes.

The following examples are provided in order to further illustrate the present invention, but should not be construed as limiting the scope thereof. Unless otherwise noted, all parts and percentages are by weight. The examples illustrate that a wrapping material coated with a mixture of alginate and hydroxypropylcellulose, particularly at relatively high coating levels, exhibits relatively high changes in diffusion capacity after being exposed to high temperature, particularly as compared to that wrapping material coated with a comparable amount of alginate but not hydroxypropylcellulose. The numerical data from the following examples are summarized in Tables 1 and 2.

EXAMPLE 1

An additive mixture including about 83.3 parts alginate and about 16.7 parts hydroxypropylcellulose is provided as follows. Tap water is heated to, and maintained at, about 60° C. Potassium sorbate is added to the water in a manner such that the potassium sorbate dissolves in the water.

Then, hydroxypropylcellulose is added to the water in a manner such that the hydroxypropylcellulose is dispersed within the water without forming lumps. The hydroxypropylcellulose is available as Klucel EF from Hercules, Inc. An aqueous mixture of that hydroxypropylcellulose as a 10 percent solution at 25° C. reportedly exhibits a viscosity of about 456 centipoise.

Then, sodium alginate is added to the water in a manner such that the alginate is dispersed within the water without forming lumps. The sodium alginate is available as Manucol LB from ISP Corporation. An aqueous mixture of that alginate as a 3 percent solution at 25° C. reportedly exhibits a viscosity of about 46.1 centipoise.

During addition of the various components to the water, the water is rapidly stirred using an electric mixer. The resulting mixture has a relatively uniform consistency. The resulting mixture is comprised of about 76.72 parts water, about 19.23 parts sodium alginate, about 3.85 parts hydroxypropylcellulose and about 0.20 parts potassium sorbate. Thus, the alginate comprises about 83.3 percent of the additive mixture and the hydroxypropylcellulose comprises about 16.7 percent of the additive mixture, based on the combined weight of the alginate and the hydroxypropylcellulose.

The resulting mixture of film-forming agent within an aqueous carrier is cooled to room temperature. The mixture at room temperature has a relatively uniform consistency and resembles a paste. After being allowed to sit for 24 hours at ambient conditions, the mixture exhibits a Brookfield viscosity (No. 6 spindle, 20 rpm, 25° C.) of about 50,000 centipoise.

An application apparatus of the type described with reference to FIG. 29 of PCT Application Pub. No. WO 04/057986 to Hancock et al. is provided. That apparatus is equipped with a bobbin of cigarette rod wrapping paper having an inherent porosity of 46 CORESTA units that is available as LK 46 from Tervakoski. The apparatus possesses an applicator system having a 20 head applicator roller that has a maximum outer diameter of about 152.8 mm, and a width of about 23 mm. Each head is about 5 mm wide, and the heads are equally spaced on at a pitch of about 19 mm. The heads of the applicator roller are fed with coating formulation from a grooved roller having an outer diameter of about 103.5 mm, and a width of about 70.5 mm. A groove of about 31 mm wide is ground in the roll face of the roller so as to extend around the peripheral face of that roller. Various wheels of varying groove grind depths are employed. The rollers and wrapping material are configured so as to provide a series of spaced bands extending transversely to the longitudinal axis of the web of wrapping material fed from the bobbin. Various grooved wheels of varying grind depths are employed in order to apply varying degrees of coating formulation to the wrapping material. The groove grind depths are 1 mil, 1.25 mil, 1.5 mil, 1.75 mil and 2 mils.

The application apparatus is operated so as to feed web of wrapping material from the bobbin through the applicator system at a rate of 100 meters per minute. As such, the coating formulation is applied to the web while the coating formulation is maintained at a temperature slightly above ambient. The coated web is dried and collected. The resulting web having spaced bands applied thereto possesses bands having applied weights of 1.5 g/m$^2$ for bands applied using the applicator roller having the 1 mil depth grooves, 2.2 g/m$^2$ for bands applied using the applicator roller having the 1.25 mil depth grooves, 2.3 g/m$^2$ for bands applied using the applicator roller having the 1.5 mil depth grooves, 2.8 g/m$^2$ for bands applied using the applicator roller having the 1.75 mil depth grooves, and 3.0 g/m$^2$ for bands applied using the applicator roller having the 2 mil depth grooves.

Diffusion capacities of the wrapping materials in the regions of the bands provided by the coating formulation are determined using the apparatus and methodologies set forth in U.S. application Ser. No. 10/695,495, filed Oct. 27, 2003. See, also, Norman et al., Measurement of Gas Diffusion Capacity of Cigarette Papers (2005).

The resulting web having spaced bands applied thereto possesses bands having diffusion capacities, measured at 25° C., of 0.741 cm/sec. for bands applied using the applicator roller having the 1 mil depth grooves, 0.410 cm/sec. for bands applied using the applicator roller having the 1.25 mil depth grooves, 0.247 cm/sec. for bands applied using the applicator roller having the 1.5 mil depth grooves, 0.140 cm/sec. for bands applied using the applicator roller having the 1.75 mil depth grooves, and 0.137 cm/sec. for bands applied using the applicator roller having the 2 mil depth grooves.

Diffusion capacities of the wrapping materials in the regions of the bands provided by the coating formulation are determined at 25° C. after heating the band region of wrapping material substantially above ambient temperature in, for example, a radiant oven at about 230° C. for about 15 minutes, and then cooling the band region to about 25° C. The resulting web having spaced bands applied thereto possesses bands having diffusion capacities of 1.026 cm/sec. for bands applied using the applicator roller having the 1 mil depth grooves, 0.794 cm/sec. for bands applied using the applicator roller having the 1.25 mil depth grooves, 0.840 cm/sec. for bands applied using the applicator roller having the 1.5 mil depth grooves, 0.740 cm/sec. for bands applied using the applicator roller having the 1.75 mil depth grooves, and 0.695 cm/sec. for bands applied using the applicator roller having the 2 mil depth grooves.

EXAMPLE 2

A coating formulation is provided, as described in Example 1. The application apparatus of the type set forth in Example 1 also is provided. The application apparatus is operated so as to feed web of wrapping material from the bobbin through the applicator system at a rate of 300 meters per minute. As such, the coating formulation is applied to the web while the coating formulation is maintained at a temperature of about 25° C. The coated web is dried and collected. The resulting web having spaced bands applied thereto possesses bands having applied weights of 1.6 g/m$^2$ for the applicator roller having the 1 mil depth grooves, 2.0 g/m$^2$ for the applicator roller having the 1.25 mil depth grooves, 2.6 g/m$^2$ for the applicator roller having the 1.5 mil depth grooves, 3.0 g/m$^2$ for the applicator roller having the 1.75 mil depth grooves, and 3.1 g/m$^2$ for the applicator roller having the 2 mil depth grooves.

Diffusion capacities of the wrapping materials in the regions of the bands provided by the coating formulation are determined. The resulting web having spaced bands applied thereto possesses bands having diffusion capacities, measured at 25° C., of 0.246 cm/sec. for bands applied using the applicator roller having the 1 mil depth grooves, 0.175 cm/sec. for bands applied using the applicator roller having the 1.25 mil depth grooves, 0.148 cm/sec. for bands applied using the applicator roller having the 1.5 mil depth grooves, 0.083 cm/sec. for bands applied using the applicator roller having the 1.75 mil depth grooves, and 0.100 cm/sec. for bands applied using the applicator roller having the 2 mil depth grooves.

Diffusion capacities of the wrapping materials in the regions of the bands provided by the coating formulation are determined at 25° C. after heating the band region of wrapping material at about 230° C. for about 15 minutes, and then cooling the band region to about 25° C. The resulting web having spaced bands applied thereto possesses bands having diffusion capacities of 0.753 cm/sec. for bands applied using the applicator roller having the 1 mil depth grooves, 0.655 cm/sec. for bands applied using the applicator roller having the 1.25 mil depth grooves, 0.761 cm/sec. for bands applied using the applicator roller having the 1.5 mil depth grooves, 0.632 cm/sec. for bands applied using the applicator roller having the 1.75 mil depth grooves, and 0.706 cm/sec. for bands applied using the applicator roller having the 2 mil depth grooves.

COMPARATIVE EXAMPLE 1

Tap water is heated to, and maintained at, about 60° C. Potassium sorbate is added to the water in a manner such that the potassium sorbate dissolves in the water. Then, sodium alginate is added to the water in a manner such that the alginate is dispersed within the water without forming lumps. The sodium alginate is available as Manucol LB from ISP Corporation, and an aqueous mixture of that alginate as a 3 percent solution at 25° C. reportedly exhibits a viscosity of about 46.1 centipoise. During addition of the various components to the water, the water is stirred using an electric mixer. The resulting mixture has a relatively uniform consistency. The resulting mixture is comprised of about 77.20 parts water, about 22.60 parts sodium alginate and about 0.20 parts potassium sorbate.

The resulting mixture of film-forming agent within an aqueous carrier is cooled to room temperature. The mixture at room temperature has a relatively uniform consistency and resembles a paste. After being allowed to sit for 24 hours at ambient conditions, the mixture exhibits a Brookfield viscosity (No. 6 spindle, 20 rpm, 25° C.) of about 50,000 centipoise.

The application apparatus of the type set forth in Example 1 also is provided. The application apparatus is operated so as to feed a web of wrapping material from the bobbin through the applicator system at a rate of 100 meters per minute. As such, the coating formulation is applied to the web while the coating formulation is maintained at a temperature slightly above ambient. The coated web is dried and collected. The resulting web having spaced bands applied thereto possesses bands having applied weights of 2.5 g/m$^2$ for the applicator roller having the 1.5 mil depth grooves, 3.0 g/m$^2$ for the applicator roller having the 1.75 mil depth grooves, and 3.0 g/m$^2$ for the applicator roller having the 2 mil depth grooves.

Diffusion coefficients of the wrapping materials in the regions of the bands provided by the coating formulation are determined. The resulting web having spaced bands applied thereto possesses bands having diffusion capacities, measured at 25° C., of 0.230 cm/sec. for bands applied using the applicator roller having the 1.5 mil depth grooves, 0.096 cm/sec. for bands applied using the applicator roller having the 1.75 mil depth grooves, and 0.100 cm/sec. for bands applied using the applicator roller having the 2 mil depth grooves.

Diffusion capacities of the wrapping materials in the regions of the bands provided by the coating formulation are determined at 25° C. after heating the band region of wrapping material in an oven at about 230° C. for about 15 minutes, and then cooling the band region to about 25° C. The resulting web having spaced bands applied thereto possesses bands having diffusion capacities of 0.378 cm/sec. for bands applied using the applicator roller having the 1.5 mil depth grooves, 0.305 cm/sec. for bands applied using the applicator roller having the 1.75 mil depth grooves, and 0.373 cm/sec. for bands applied using the applicator roller having the 2 mil depth grooves.

COMPARATIVE EXAMPLE 2

A coating formulation is provided as described in Comparative Example 1. The application apparatus of the type set forth in Example 1 also is provided. The application apparatus of the type set forth in Example 1 also is provided. The application apparatus is operated so as to feed a web of wrapping material from the bobbin through the applicator system at a rate of 300 meters per minute. As such, the coating formulation is applied to the web while the coating formulation is maintained at a temperature slightly above ambient. The coated web is dried and collected. The resulting web having spaced bands applied thereto possesses bands having applied weights of 2.2 g/m$^2$ for the applicator roller having the 1.5 mil depth grooves, 2.9 g/m$^2$ for the applicator roller having the 1.75 mil depth grooves, and 2.6 g/m$^2$ for the applicator roller having the 2 mil depth grooves.

Diffusion capacities of the wrapping materials in the regions of the bands provided by the coating formulation are determined. The resulting web having spaced bands applied thereto possesses bands having diffusion capacities, measured at 25° C., of 0.123 cm/sec. for bands applied using the applicator roller having the 1.5 mil depth grooves, 0.096 cm/sec. for bands applied using the applicator roller having the 1.75 mil depth grooves, and 0.079 cm/sec. for bands applied using the applicator roller having the 2 mil depth grooves.

Diffusion capacities of the wrapping materials in the regions of the bands provided by the coating formulation are determined at 25° C. after heating the band region of wrapping material in an oven at about 230° C. for about 15 minutes, and then cooling the band region to about 25° C. The resulting web having spaced bands applied thereto possesses bands having diffusion capacities of 0.554 cm/sec. for bands applied using the applicator roller having the 1.5 mil depth grooves, 0.467 cm/sec. for bands applied using the applicator roller having the 1.75 mil depth grooves, and 0.495 cm/sec. for bands applied using the applicator roller having the 2 mil depth grooves.

TABLE 1

Examples of Wrappers with Alginate and Hydroxypropylcellulose

| Groove Depth | Example 1 Coating Density | Example 1 Diffusion Capacity (cm/sec) | | Example 2 Coating Density | Example 2 Diffusion Capacity (cm/sec) | |
|---|---|---|---|---|---|---|
| (mil) | ($g/m^2$) | Unheated | Heated | ($g/m^2$) | Unheated | Heated |
| 1 | 1.5 | 0.741 | 1.026 | 1.6 | 0.246 | 0.753 |
| 1.25 | 2.2 | 0.410 | 0.794 | 2.0 | 0.175 | 0.655 |
| 1.5 | 2.3 | 0.247 | 0.840 | 2.6 | 0.148 | 0.761 |
| 1.75 | 2.8 | 0.140 | 0.740 | 3.0 | 0.083 | 0.632 |
| 2 | 3.0 | 0.137 | 0.695 | 3.1 | 0.100 | 0.706 |

TABLE 2

Comparative Examples of Wrappers with Alginate

| Groove Depth | Comparative Example 1 Coating Density | Comparative Example 1 Diffusion Capacity (cm/sec) | | Comparative Example 2 Coating Density | Comparative Example 2 Diffusion Capacity (cm/sec) | |
|---|---|---|---|---|---|---|
| (mil) | ($g/m^2$) | Unheated | Heated | ($g/m^2$) | Unheated | Heated |
| 1.5 | 2.5 | 0.230 | 0.378 | 2.2 | 0.123 | 0.554 |
| 1.75 | 3.0 | 0.096 | 0.305 | 2.9 | 0.096 | 0.467 |
| 2 | 3.0 | 0.100 | 0.373 | 2.6 | 0.079 | 0.495 |

As was surprisingly found in the examples related above, an additive material including alginate and hydroxypropylcellulose applied to wrapping material that is heated at about 230° C. for about 15 minutes results in diffusion capacity that is notably greater than an application of such a mixture without heating, and is also notably greater than an application consisting essentially of alginate, whether that alginate application is heated or not.

It is therefore intended that the foregoing detailed description be regarded as illustrative rather than limiting, and that it be understood that it is the following claims, including all equivalents, that are intended to define the spirit and scope of this invention.

We claim:

1. A wrapping material for a smokable rod of a cigarette, the wrapping material comprising a base sheet and an additive material applied to at least one major surface thereof, the additive material comprising alginate and hydroxypropylcellulose in a pattern comprising at least one band configured to be disposed in a predetermined location when the wrapping material is assembled to a cigarette, wherein the predetermined location is generally transverse to a longitudinal axis of a cigarette, and is in communication with smokable material so as to be burned therewith;

wherein the alginate within the additive material makes up at least about 65 percent of the combined weight of the alginate and hydroxypropylcellulose within the additive material, and the hydroxypropylcellulose within the additive material makes up at least about 5 percent of the combined weight of the alginate and hydroxypropylcellulose within the additive material; and wherein the additive material provides a desirable extinction criteria for a cigarette by providing a diffusion capacity of a wrapping material region coated by the at least one band that is at least about 0.5 cm/sec and an inherent porosity of less than 9 CORESTA units.

2. The wrapping material of claim 1 wherein the alginate includes sodium alginate.

3. The wrapping material of claim 1 wherein the alginate exhibits a viscosity of about 20 centipoise to about 100 centipoise, when present in a 3 percent by weight solution in water at 25° C.

4. The wrapping material of claim 1 wherein the hydroxypropylcellulose exhibits a viscosity of about 200 centipoise to about 600 centipoise when present in a 10 percent by weight solution in water at 25° C.

5. The wrapping material of claim 1 wherein the additive material applied to the wrapping material is such that the additive material on the wrapping material possesses a dry weight application of least about 1 $g/m^2$.

6. The wrapping material of claim 1 wherein the additive material applied to the wrapping material is such that the additive material on the wrapping material possesses a dry weight application of least about 2 $g/m^2$.

7. The wrapping material of claim 1 wherein the additive material applied to the wrapping material is such that the additive material on the wrapping material possesses a dry weight application of less than about 7 $g/m^2$.

8. The wrapping material of claim 1 wherein the additive material applied to the wrapping material is such that the additive material on the wrapping material possesses a dry weight application of less than about 4 $g/m^2$.

9. The wrapping material of claim 1 wherein wrapping material where additive material is applied thereto exhibits an inherent porosity from about 3 CORESTA units to about 6 CORESTA units.

10. The wrapping material of claim 1 wherein the at least one band comprises a series of spaced bands.

11. The wrapping material of claim 1, wherein the at least one band comprises, a series of spaced bands that extend across the wrapping material generally perpendicular to the longitudinal axis of the wrapping material and wherein each spaced band has a width of about 2 mm to about 8 mm, and wherein the spaced bands are about 10 mm to about 50 mm from one another.

12. The wrapping material of claim 1, wherein a region of the wrapping material with a band of additive material has a diffusion capacity greater than about 0.6 cm/sec.

13. The wrapping material of claim 12, wherein a coating density is at least about 2 $g/m^2$.

14. The wrapping material of claim 1, wherein the additive material includes a component selected from the group consisting of humectant, wetting agent, preservative, and a combination thereof.

15. A smoking article comprising:

a smokable rod and the wrapping material of claim 1 circumscribing the smokable rod, wherein the at least one band is generally transverse to a longitudinal axis of the smoking rod, and wherein the at least one band is in communication with smokable material so as to be burned therewith when the smoking article is used.

16. The smoking article of claim 15 wherein the alginate includes sodium alginate.

17. The smoking article of claim 15 wherein the alginate exhibits a viscosity of about 20 centipoise to about 100 centipoise, when present in a 3 percent by weight solution in water at 25° C.

18. The smoking article of claim 15 wherein the hydroxypropylcellulose exhibits a viscosity of about 200 centipoise to about 600 centipoise when present in a 10 percent by weight solution in water at 25° C.

19. The smoking article of claim 15 wherein the additive material applied to the wrapping material is such that the additive material on the wrapping material possesses a dry weight application of least about 1 g/m$^2$.

20. The smoking article of claim 15 wherein the additive material applied to the wrapping material is such that the additive material on the wrapping material possesses a dry weight application of least about 2 g/m$^2$.

21. The smoking article of claim 15 wherein the additive material applied to the wrapping material such that the additive material on the wrapping material possesses a dry weight application of less than about 7 g/m$^2$.

22. The smoking article of claim 15 wherein the additive material applied to the wrapping material such that the additive material on the wrapping material possesses a dry weight application of less than about 4 g/m$^2$.

23. The smoking article of claim 15 wherein wrapping material where additive material is applied thereto exhibits an inherent porosity from about 3 CORESTA units to about 6 CORESTA units.

24. The smoking article of claim 15, having a longitudinal axis, wherein the at least one band comprises a series of spaced bands that extend across the wrapping material generally perpendicular to the longitudinal axis of the smoking article.

25. The smoking article of claim 15 having a longitudinal axis, wherein the at least one band comprises a series of spaced bands that extend across the wrapping material generally perpendicular to the longitudinal axis of the wrapping smoking article, and wherein each spaced band has a width of about 4 mm to about 7 mm, and wherein the spaced bands are about 15 mm to about 25 mm from one another.

26. A method of making a coated wrapping material, the method comprising the steps of:

providing a wrapping paper configured for encompassing and being burned with a smokable rod of a cigarette;

providing a coating formulation that comprises an alginate, hydroxypropylcellulose, and a liquid carrier, wherein the alginate within the coating formulation makes up at least about 65 percent of the combined weight of the alginate and hydroxypropylcellulose within the additive material, and the hydroxypropylcellulose within the additive material makes up at least about 5 percent of the combined weight of the alginate and hydroxypropylcellulose within the additive material;

applying the coating formulation to at least a portion of the wrapping material in a pattern comprising at least one band configured to be disposed in a predetermined location when the wrapping material is assembled to a cigarette, wherein the predetermined location is generally transverse to a longitudinal axis of a cigarette, and is in communication with smokable material so as to be burned therewith; and heating the wrapping material at about 230° C. for about 15 minutes.

27. The method of claim 26, wherein the portion of the wrapping material with the coating formulation applied comprises at least one band.

28. The method of claim 26, wherein the coating formulation is maintained at a temperature between about 25° C. and 60° C. during application.

29. The method of claim 26, wherein the coating formulation provided comprises about 10 to about 35 percent by combined weight of alginate and hydroxypropylcellulose in a liquid carrier.

30. The method of claim 26, further comprising a step of heating the wrapping material at about 230° C. for about 15 minutes.

31. A wrapping material for a cigarette, prepared by a process comprising the steps of providing a base sheet;

providing an additive material comprising alginate and hydroxypropylcellulose, wherein the alginate makes up at least about 65 percent of the combined weight of the alginate and hydroxypropylcellulose, and the hydroxypropylcellulose makes up at least about 5 percent of the combined weight of the alginate and hydroxypropylcellulose;

applying the additive material to the base sheet in a pattern comprising at least one band configured to be disposed in a predetermined location when the wrapping material is assembled to a cigarette, wherein the predetermined location is generally transverse to a longitudinal axis of a cigarette, and is in communication with smokable material so as to be burned therewith; and heating the wrapping material at about 230° C. for about 15 minutes such that the additive material provides a desirable extinction criteria for a cigarette by providing a diffusion capacity of a wrapping material region coated by the at least one band that is at least about 0.5 cm/sec and an inherent porosity of less than 9 CORESTA units.

32. A cigarette comprising:

the wrapping material of claim 31;

a rod of smokable material; and a filter including a proximal mouth end and a distal attachment end;

wherein the rod of smokable material is attached distally to the distal attachment end of the filter;

wherein the wrapping material circumscribes the rod of smokable material such that the at least one band is generally transverse to a longitudinal axis of the cigarette, and is in communication with the rod of smokable material so as to be burned therewith.

33. The wrapping material of claim 31, wherein the additive material includes, for a combined weight of hydroxypropylcellulose and alginate, about 5% to about 35% hydroxypropylcellulose and about 65% to about 75% alginate.

* * * * *

UNITED STATES PATENT AND TRADEMARK OFFICE

CERTIFICATE OF CORRECTION

PATENT NO. : 7,600,518 B2
APPLICATION NO. : 11/109404
DATED : October 13, 2009
INVENTOR(S) : Oglesby et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1099 days.

Signed and Sealed this

Fifth Day of October, 2010

David J. Kappos

David J. Kappos
*Director of the United States Patent and Trademark Office*